US007057870B2

(12) United States Patent
Meyer et al.

(10) Patent No.: US 7,057,870 B2
(45) Date of Patent: Jun. 6, 2006

(54) INDUCTIVE LOAD DRIVER CIRCUIT AND SYSTEM

(75) Inventors: William D. Meyer, Columbus, IN (US); Bjorn S. Westman, Ekero (SE); Dan D. Wilhem, Nashville, IN (US); Richard J. Dudek, Columbus, IN (US)

(73) Assignee: Cummins, Inc., Columbus, IN (US)

( * ) Notice: Subject to any disclaimer, the term of this patent is extended or adjusted under 35 U.S.C. 154(b) by 503 days.

(21) Appl. No.: 10/621,834

(22) Filed: Jul. 17, 2003

(65) Prior Publication Data

US 2005/0047053 A1 Mar. 3, 2005

(51) Int. Cl.
*H01H 47/00* (2006.01)

(52) U.S. Cl. ..... 361/139

(58) Field of Classification Search ..... 361/139
See application file for complete search history.

(56) References Cited

U.S. PATENT DOCUMENTS 4,112,477 A 9/1978 Sherwin
4,287,550 A 9/1981 Wada
4,327,693 A * 5/1982 Busser ..... 123/490
4,377,144 A 3/1983 Takahashi
4,479,161 A 10/1984 Henrich et al.
4,604,674 A 8/1986 Hamel
4,604,675 A 8/1986 Pflederer
4,637,742 A * 1/1987 Sakai ..... 400/124.02
4,661,882 A * 4/1987 Presley ..... 361/159
4,774,624 A 9/1988 Qualich
4,775,914 A 10/1988 Incardona
4,835,655 A * 5/1989 Ricci et al. ..... 361/159
4,862,866 A 9/1989 Calfus
4,933,805 A 6/1990 Calfus
4,950,974 A 8/1990 Pagano
5,036,422 A 7/1991 Uchida et al.
5,053,911 A 10/1991 Kopec et al.
5,267,545 A 12/1993 Kitson
5,341,032 A 8/1994 Brambilla et al.
5,402,760 A 4/1995 Takeuchi et al.
5,430,601 A 7/1995 Burcham
5,523,632 A 6/1996 Seragnoli
5,532,526 A 7/1996 Ricco et al.
5,687,050 A 11/1997 Bartsch
5,711,280 A 1/1998 Foerster et al.
5,717,562 A 2/1998 Antone et al.
5,729,422 A 3/1998 Henke
5,877,931 A 3/1999 Groppo et al.
5,936,440 A * 8/1999 Asada et al. ..... 327/110
5,936,827 A 8/1999 Dressler et al.
5,940,262 A 8/1999 Archer
5,982,604 A * 11/1999 Kojima et al. ..... 361/159
5,992,401 A * 11/1999 Bylsma et al. ..... 123/596
6,031,707 A * 2/2000 Meyer ..... 361/153
6,175,484 B1 1/2001 Caruthers et al.
6,222,719 B1 * 4/2001 Kadah ..... 361/247
6,407,593 B1 6/2002 Kawamoto et al.
6,452,815 B1 * 9/2002 Zhu et al. ..... 363/17
6,577,488 B1 * 6/2003 Seifert et al. ..... 361/156
6,631,067 B1 * 10/2003 Newton et al. ..... 361/154

* cited by examiner

*Primary Examiner*—Stephen W. Jackson
*Assistant Examiner*—James A. Demakis
(74) *Attorney, Agent, or Firm*—Barnes & Thornburg LLP

(57) ABSTRACT

A circuit and system is disclosed for driving one or more inductive loads, or one or more electrical loads including one or more inductive components. A control computer is configured to selectively supply a boost voltage to the one or more inductive loads, and to controllably commutate energy stored in one or more of the inductive loads back to a rechargeable source of the boost voltage.

42 Claims, 4 Drawing Sheets

INDUCTIVE LOAD DRIVER CIRCUIT AND SYSTEM

FIELD OF THE DISCLOSURE

The present invention relates generally to systems for driving inductive loads or other electrical loads having one or more inductive components, and more specifically to systems for recharging a rechargeable boost voltage source configured for selective application to the one or more inductive loads.

BACKGROUND OF THE DISCLOSURE

In systems for driving inductive loads, or electrical loads having one or more inductive components, it may be desirable to provide for an auxiliary or boost voltage for selective application to one or more of the inductive loads, wherein such a boost voltage is typically greater than the system supply voltage normally applied to the one or more inductive loads. Such a boost voltage may be selectively applied to one or more of the inductive loads to, for example, cause the rate at which current rises through the one or more inductive loads to increase over that which would have otherwise occurred by applying only the system supply voltage to the one or more inductive loads.

In systems including such a boost voltage, it may further be desirable to provide the source of boost voltage in the form of a rechargeable voltage supply. The various embodiments described herein are directed to techniques for recharging such a rechargeable boost voltage supply.

SUMMARY OF THE DISCLOSURE

The present invention may comprise one or more of the following features or combinations thereof. Circuitry for driving an inductive load may comprise a battery switch having an open position and a closed position supplying a battery voltage to a high side of the inductive load, a boost switch having an open position and a closed position supplying a boost voltage, greater than the battery voltage, to the high side of the inductive load, a low-side switch having an open position and a closed position coupling a low-side of the inductive load to ground potential, a capacitor having one terminal referenced to the battery voltage and an opposite terminal supplying the boost voltage to the boost switch, a commutating diode having an anode connected to the low-side of the inductive load and a cathode connected to the opposite terminal of the capacitor, and a control computer. The control computer may be configured to control the battery switch, boost switch and low-side switch to control current flow through the inductive load, and to direct energy in the inductive load to the opposite terminal of the capacitor via the commutating diode to charge the capacitor by controlling the boost switch and the low-side switch to their open positions.

The control computer may further be operable to control the battery switch to its closed position when directing energy in the inductive load to the opposite terminal of the capacitor via the commutating diode.

Alternatively, the control computer may further be operable to control the battery switch to its open position when directing energy in the inductive load to the opposite terminal of the capacitor via the commutating diode.

The inductive load may be a solenoid configured to control operation of a fuel injector.

The circuitry may include a blocking diode having an anode connected to one terminal of the battery switch and a cathode connected to the high side of the inductive load, wherein an opposite terminal of the battery switch may be connected to the battery voltage. The battery switch may be configured in its closed position to connect the battery voltage to the high side of the inductive load with the blocking diode blocking current flow through the battery switch to the battery voltage, and in its open position to disconnect the battery voltage from the high side of the inductive load. One terminal of the boost switch may be connected to the opposite terminal of the capacitor, and an opposite terminal of the boost switch may be connected to the high side of the inductive load, wherein the boost switch is configured in its closed position to connect the boost voltage to the high side of the inductive load, and in its open position to disconnect the boost voltage from the high side of the inductive load.

Alternatively, the blocking diode may have its anode connected to the battery voltage and its cathode connected to one terminal of the battery switch, wherein an opposite terminal of the battery switch may be connected to the high side of the inductive load. The battery switch may be configured in its closed position to connect the battery voltage to the high side of the inductive load with the blocking diode blocking current flow from the one terminal of the battery switch to the battery voltage, and it its open position to disconnect the battery voltage from the high side of the inductive load. One terminal of the boost switch may be connected to the opposite terminal of the capacitor, and an opposite terminal of the boost switch may be connected to the one terminal of the battery switch, wherein the boost switch is configured in its closed position to connect the boost voltage to the high side of the inductive load when the battery switch is also in its closed position, and in its open position to disconnect the boost voltage from the one terminal of the battery switch.

The circuitry may include a recirculation diode having a cathode connected to the high side of the inductive load and an anode connected to ground potential, wherein the recirculation diode is operable to conduct load current from the inductive load therethrough when the load current is decaying through the inductive load, and a buffer circuit having an input connected to the high side of the inductive load and an output producing a voltage source feedback signal. The voltage source feedback signal may have a first logic state when the boost switch is in its closed position, the battery switch is in its closed position or the boost switch, battery switch and low-side switch are all in their open positions and no load current from the inductive load is being conducted through the recirculation diode, and otherwise having a second logic state different than the first logic state.

The control computer may be configured to control the battery switch, boost switch and low-side switch to control load current flow through the inductive load according to a series of current pulses. The control computer may be configured to initiate each of the series of current pulses by controlling the low-side switch to its closed position followed by controlling either of the boost switch and/or the battery switch to its closed position to cause the load current through the inductive load to increase. The control computer may further be configured to monitor the voltage source feedback signal and controlling either of the boost switch and the battery switch to its closed position only if the voltage source feedback signal is in its second logic state after the low-side switch is controlled to its closed position. The voltage source feedback signal may indicate a circuit open or short condition if the voltage source feedback signal is in its first logic state after the low-side switch is controlled to its closed position.

Each of the boost switch, the battery switch and the low-side switch may be in its open position with no load current flowing through the recirculation diode prior to controlling the low-side switch to its closed position. The control computer may be configured to control either of the boost switch or the battery switch to its closed position only if the voltage source feedback signal switches from its first logic state to its second logic state when the low-side switch is controlled to its closed position. The voltage source feedback signal may indicate a circuit open or short condition if the voltage source feedback signal is either in its second logic state before the low-side switch is controlled to its closed position or in its first logic state after the low-side switch is controlled to its closed position.

The control computer may be configured to control either of the boost switch and the battery switch to its open position when the load current through the inductive load increases to a peak current level. The control computer may be configured to determine a duration of load current rise to the peak current level as a time difference between switching of the voltage source feedback signal from its second logic state to its first logic state when either of the boost switch and the battery switch is controlled to its closed position and switching of the voltage source feedback signal from its first logic state to its second logic state when either of the boost switch and the battery switch is thereafter controlled to its open position.

The circuitry may further include a plurality of inductive loads having high sides all connected together, a corresponding plurality of commutating diodes each having an anode connected to a low-side of an associated one of the plurality of inductive loads, and a cathode connected to the opposite terminal of the capacitor, and a corresponding plurality of low-side switches each having an open position and a closed position coupling a low-side of an associated one of the plurality of inductive loads to ground potential. The control computer may be configured to control the battery switch, boost switch and plurality of low-side switches to control current flow through the plurality of inductive loads, and to direct energy from the plurality of inductive loads to the opposite terminal of the capacitor via associated ones of the plurality of commutating diodes to charge the capacitor by controlling the boost switch and the associated ones of the plurality of low-side switches to their open positions. The control computer may further be operable to control the battery switch to its closed position when directing energy in the plurality of inductive loads to the opposite terminal of the capacitor via the associated ones of the plurality of commutating diodes. Alternatively, the control computer may further be operable to control the battery switch to its open position when directing energy in the plurality of inductive loads to the opposite terminal of the capacitor via the associated ones of the plurality of commutating diodes.

The control computer may be configured to command a series of capacitor recharge pulses to recharge the capacitor. The control computer may be configured for each of the series of capacitor recharge pulses to control the battery switch and each of the plurality of low-side switches to their closed positions while controlling the boost switch to its open position to cause load currents through each of the plurality of inductive loads to increase, followed by controlling each of the plurality of low-side switches to their open positions to direct energy from each of the plurality of inductive loads through a respective one of the plurality of commutating diodes to the opposite terminal of the capacitor. Each of the plurality of inductive loads may be a solenoid configured to control operation of one of a corresponding plurality of fuel injectors, wherein the control computer may be configured to control the durations of the closed positions of the battery switch and each of the plurality of low-side switches for each of the series of capacitor recharge pulses to limit the load current through each of the plurality of solenoids below a level sufficient to actuate an associated one of the corresponding plurality of fuel injectors.

Circuitry for driving an inductive load may comprise a battery switch having an open position and a closed position supplying a battery voltage to a high side of the inductive load, a low-side switch having an open position and a closed position coupling a low-side of the inductive load to ground potential, a recirculation diode having a cathode connected to the high side of the inductive load and an anode connected to ground potential, wherein the recirculation diode is operable to conduct load current from the inductive load therethrough when load current is decaying through the inductive load, a buffer circuit having an input connected to the high side of the inductive load and an output producing a voltage source feedback signal, the voltage source feedback signal having a first logic state when either the battery switch is in its closed position or the battery switch and low-side switch are each in their open positions and no load current from the inductive load is being conducted through the recirculation diode, and otherwise having a second logic state different than the first logic state. A control computer may be configured to control the battery switch and the low-side switch to control load current through the inductive load according to a series of current pulses, and to initiate each of the series of current pulses by controlling the low-side switch to its closed position followed by controlling the battery switch to its closed position to cause the load current through the inductive load to increase. The control computer may monitor the voltage source feedback signal and control the battery switch to its closed position only if the voltage source feedback signal is in its second logic state after the low-side switch is controlled to its closed position. The voltage source feedback signal may indicate a circuit open or short condition if the voltage source feedback signal is in its first logic state after the low-side switch is controlled to its closed position.

The battery switch and the low-side switch may be in their open positions with no load current flowing through the recirculation diode prior to controlling the low-side switch to its closed position. The control computer may be configured to control the battery switch to its closed position only if the voltage source feedback signal switches from its first logic state to its second logic state when the low-side switch is controlled to its closed position. The voltage source feedback signal may indicate a circuit open or short condition if the voltage source feedback signal is either in its second logic state before the low-side switch is controlled to its closed position or in its first logic state after the low-side switch is controlled to its closed position.

The circuitry may include a boost switch having an open position and a closed position supplying a boost voltage, greater than the battery voltage, to the high side of the inductive load, a capacitor having one terminal referenced to the battery voltage and an opposite terminal supplying the boost voltage to the boost switch, and a commutating diode having an anode connected to the low-side of the inductive load and a cathode connected to the opposite terminal of the capacitor. The control computer may be configured to control the boost switch to control load current through the inductive load, and to direct energy in the inductive load through the commutating diode to the opposite terminal of the capacitor to charge the capacitor by controlling the low-side switch and boost switch to their open positions. The control computer may further be operable to control the battery switch to its closed position when directing energy in the inductive load through the commutating diode to the opposite terminal of the capacitor. Alternatively, the control computer may further be operable to control the battery switch to its open position when directing energy in the inductive load through the commutating diode to the opposite terminal of the capacitor. The inductive load may be a solenoid configured to control operation of a fuel injector.

Circuitry for driving an inductive load may comprise a battery switch having an open position and a closed position supplying a battery voltage to a high side of the inductive load, a boost switch having an open position and a closed position supplying a boost voltage, greater than the battery voltage, to the high side of the inductive load, a capacitor supplying the boost voltage to the boost switch, a low-side switch having an open position and a closed position coupling a low-side of the inductive load to ground potential, a commutating diode having an anode connected to the low-side of the inductive load and a cathode connected to the capacitor, a recirculation diode having a cathode connected to the high side of the inductive load and an anode connected to ground potential, wherein the recirculation diode is operable to conduct load current from the inductive load therethrough when the load current is decaying through the inductive load, a buffer circuit having an input connected to the high side of the inductive load and an output producing a voltage source feedback signal, the voltage source feedback signal having a first logic state when the boost switch is in its closed position, the battery switch is in its closed position or the boost switch, battery switch and low-side switch are all in their open positions and no load current from the inductive load is being conducted through the recirculation diode, and otherwise having a second logic state different than the first logic state, and a control computer. The control computer may be configured to control the battery switch, boost switch and low-side switch to control load current flow through the inductive load according to a series of current pulses, and to initiate each of the series of current pulses by controlling the low-side switch to its closed position followed by controlling either of the boost switch and the battery switch to its closed position to cause the load current through the inductive load to increase. The control computer may monitor the voltage source feedback signal and controlling either of the boost switch and the battery switch to its closed position only if the voltage source feedback signal is in its second logic state after the low-side switch is controlled to its closed position. The voltage source feedback signal may indicate a circuit open or short condition if the voltage source feedback signal is in its first logic state after the low-side switch is controlled to its closed position.

Each of the boost switch, the battery switch and the low-side switch may be in its open position with no load current flowing through the recirculation diode prior to controlling the low-side switch to its closed position, and the control computer may be configured to control either of the boost switch and the battery switch to its closed position only if the voltage source feedback signal switches from its first logic state to its second logic state when the low-side switch is controlled to its closed position. The voltage source feedback signal may indicate a circuit open or short condition if the voltage source feedback signal is either in its second logic state before the low-side switch is controlled to its closed position or in its first logic state after the low-side switch is controlled to its closed position.

The control computer may be configured to control either of the boost switch and the battery switch to its open position when the load current through the inductive load increases to a peak current level. The control computer may be configured to determine a duration of load current rise to the peak current level as a time difference between switching of the voltage source feedback signal from its second logic state to its first logic state when either of the boost switch and the battery switch is controlled to its closed position and switching of the voltage source feedback signal from its first logic state to its second logic state when either of the boost switch and the battery switch is thereafter controlled to its open position.

Circuitry for driving a plurality of inductive loads may comprise a battery switch having an open position and a closed position supplying a battery voltage to high sides of the plurality of inductive loads, a boost switch having an open position and a closed position supplying a boost voltage, greater than the battery voltage, to the high sides of the plurality of inductive loads, a plurality of low-side switches each having an open position and a closed position coupling a low-side of a corresponding one of the plurality of inductive loads to ground potential, a capacitor supplying the boost voltage to the boost switch, a plurality of commutating diodes each having an anode connected to the low-side of a corresponding one of the plurality of inductive loads and a cathode connected to the capacitor, and a control computer. The control computer may be configured to control the battery switch, boost switch and plurality low-side switches to control load current flow through the plurality of inductive loads, the control computer commanding a series of capacitor recharge pulses to recharge the capacitor by controlling the battery switch and each of the plurality of low-side switches to their closed positions while controlling the boost switch to its open position to cause load currents through each of the plurality of inductive loads to increase, followed by controlling each of the plurality of low-side switches to their open positions to direct energy from each of the plurality of inductive loads through a respective one of the plurality of commutating diodes to the capacitor. Each of the plurality of inductive loads may be a solenoid configured to control operation of one of a corresponding plurality of fuel injectors, and the control computer may be configured to control the durations of the closed positions of the battery switch and each of the plurality of low-side switches for each of the series of capacitor recharge pulses to limit the load current through each of the plurality of solenoids below a level sufficient to actuate an associated one of the corresponding plurality of fuel injectors.

Circuitry for driving an inductive load may comprise a high-side switch having an open position and a closed position supplying a source voltage to a high side of the inductive load, a low-side switch having an open position and a closed position coupling a low-side of the inductive load to ground potential, and a recirculation diode having a cathode connected to the high side of the inductive load and an anode connected to ground potential, wherein the recirculation diode conducts load current therethrough when the load current is decaying through the inductive load. A buffer circuit may have an input connected to the high side of the inductive load and an output producing a voltage source feedback signal, wherein the voltage source feedback signal may have a first logic state when either the battery switch is in its closed position or the battery switch and low-side switch are each in their open positions and no load current from the inductive load is being conducted through the recirculation diode, and may otherwise have a second logic state different than the first logic state. A control computer may be configured to control the low-side switch to its closed position followed by controlling the high-switch to its closed position to cause the load current through the inductive load to increase, followed by controlling the high-side switch to its open position when the load current through the inductive load increases to a peak current level. The control computer may be configured to determine a duration of load current rise to the peak current level as a time difference between switching of the voltage source feedback signal from its second logic state to its first logic state when the high-side switch is controlled to its closed position and switching of the voltage source feedback signal from its first logic state to its second logic state when the high-side switch is thereafter controlled to its open position.

These and other objects of the present invention will become more apparent from the following description of the illustrative embodiments.

DESCRIPTION OF THE ILLUSTRATIVE EMBODIMENTS

Figure 1:
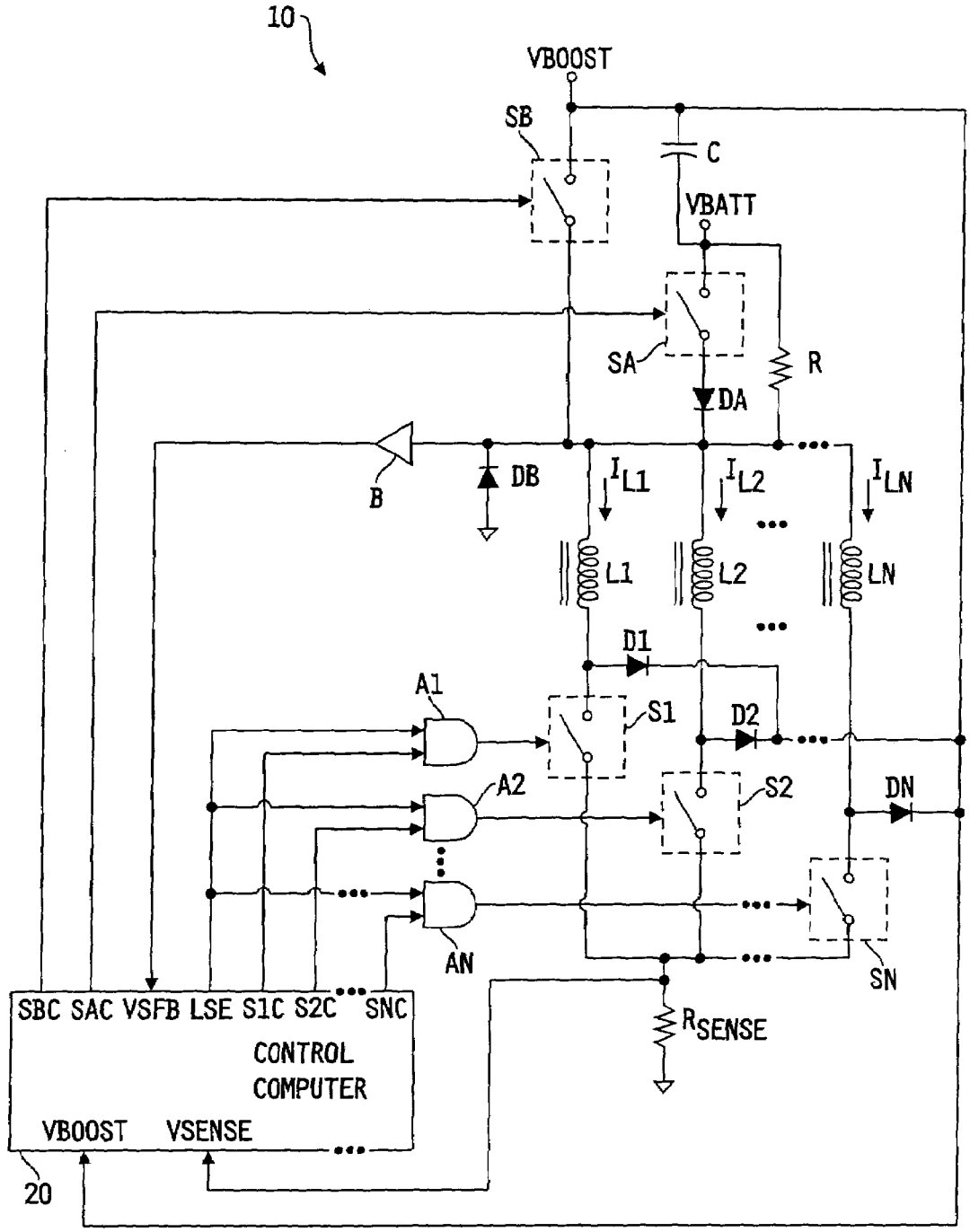
FIG. 1 is a diagram of one illustrative embodiment of an inductive load driver circuit and system.

For the purposes of promoting an understanding of the principles of the invention, reference will now be made to a number of illustrative embodiments shown in the drawings and specific language will be used to describe the same. It will nevertheless be understood that no limitation of the scope of the invention is thereby intended.

Referring now to FIG. 1, a diagram of one illustrative embodiment of an inductive load driver circuit and system 10 is shown. Circuit and system 10 includes a battery voltage source, VBATT, electrically connected to one terminal of a battery switch, SA, having an opposite terminal electrically connected to an anode of a blocking diode, DA. In one embodiment, the battery voltage source, VBATT, is a motor vehicle battery producing a DC voltage that is illustratively in the range of 6–36 volts, although the battery voltage source, VBATT, may alternatively be any suitable voltage source producing any desired constant, variable or varying voltage. The battery voltage source, VBATT, is further connected to one terminal of a resistor, R, having an illustrative value of 5 kohms, although R may alternatively be selected to have any desired resistance value suitable for the particular application of circuit and system 10. Circuit and system 10 further includes a capacitor, C, having one terminal connected to the battery voltage source, VBATT, and an opposite terminal electrically connected to one terminal of a boost switch, SB. The capacitor, C, is chargeable in a manner that will be described more fully hereinafter, to produce a boost voltage, VBOOST, greater than the battery voltage produced by the battery voltage source, VBATT. In one illustrative embodiment, the capacitor, C, is sized to provide a maximum boost voltage, $VB_{MAX}$, in the range of 60–130 volts, although the capacitor, C, may alternatively be sized to produce any desired maximum boost voltage, $VB_{MAX}$.

The circuit and system 10 further includes a number, N, of inductive loads, L1–LN, wherein N may be any positive integer. In one illustrative embodiment, for example, inductive loads L1–LN represent "N" solenoids each configured to control operation of a corresponding fuel injector for an internal combustion engine, although generally, the number of inductive loads L1–L2 may be any purely inductive loads, or alternatively any electrical loads having inductive properties or one or more inductive components. In any case, the cathode of blocking diode DA, the opposite terminal of resistor R, and the opposite terminal of switch SB are each connected to the high sides of inductive loads L1–LN as illustrated in FIG. 1. A recirculation diode, DB, has a cathode electrically connected to the high sides of each of the number of inductive loads L1–LN and an anode electrically connected to ground potential.

The low-sides of the inductive loads L1–LN are each electrically connected to an anode of one of a corresponding number of commutating diodes D1–DN, as well as to one terminal of a corresponding number of low-side switches S1–SN. The cathodes of each of the diodes D1–DN are electrically connected to the VBOOST terminal of the capacitor C. Opposite terminals of the number of low-side switches S1–SN are all electrically connected to one terminal of a sense resistor, $R_{SENSE}$, having an opposite terminal electrically connected to ground potential. Those skilled in the art will recognize that the sense resistor, $R_{SENSE}$, is included to allow monitoring of the load current through any of the inductive loads, L1–LN, via monitoring of the voltage drop across $R_{SENSE}$. In this embodiment, $R_{SENSE}$ is typically a small-valued resistor, e.g., less than one ohm, to minimize the voltage drop across $R_{SENSE}$, although $R_{SENSE}$ may alternatively be set at any desired value. In an alternate embodiment, one or more other known load current sensors may be used, in which case $R_{SENSE}$ may be omitted and the low-sides of each of the number of inductive loads L1–LN may be connected directly to ground potential.

Circuit and system 10 further includes a control computer 20. In one embodiment, control computer 20 is microprocessor-based and includes at least a memory portion, digital I/O and a number of analog-to-digital (A/D) inputs. The memory portion of control computer 20 may include ROM, RAM, EPROM, EEPROM, FLASH memory and/or any other memory known to those skilled in the art. The memory portion may further be supplemented by external memory connected thereto. In any case, the microprocessor portion of control computer 20 runs software routines and manages the overall operation of circuit and system 10. Control computer 20 may be a known control unit sometimes referred to as an electronic or engine control module (ECM), electronic or engine control unit (ECU) or the like, or may alternatively be a general purpose control computer, digital or mixed signal application specific integrated circuit (ASIC) and/or combination of discrete digital and analog circuits capable of operation as will be described hereinafter.

Control computer 20 includes a number of control outputs electrically connected to corresponding control inputs of the various switches described hereinabove. For example, a battery switch control output, SAC, is electrically connected to a control input of battery switch SA and a boost switch output, SBC, of control computer 20 is electrically connected to a control input of boost switch SB. Control computer 20 is operable to control, via battery switch control output SAC, the battery switch SA between an open position and a closed position, wherein battery switch SA is operable in its closed position to supply battery voltage from battery voltage source VBATT to the high sides of the inductive loads L1–LN with the blocking diode, DA, blocking current flow through switch SA to the battery voltage source, VBATT. Control computer 20 is likewise operable to control, via boost switch control output SBC, the boost switch SB between an open position and a closed position, wherein boost switch SB is operable in its closed position to supply boost voltage VBOOST, supplied by capacitor C, to the high sides of the inductive loads L1–LN.

A number of low-side switch control outputs, S1C–SNC of control computer 20 are each electrically connected to one input of one a corresponding number of 2-input AND gates A1–AN, and a load switch enable output, LSE, of control computer 20 is electrically connected to the second input of each of the number of 2-input AND gates A1–AN. The outputs of each of the number of 2-input AND gates A1–AN are electrically connected to a control input of a corresponding one of the number of low-side switches S1–S2. Control computer 20 is operable to control, via the load switch enable output LSE and the number of low-side switch control outputs S1–SN, each of the low-side switches S1–SN between open and closed positions, wherein each low-side switch S1–SN is operable in its closed position to couple a corresponding one of the number of inductive loads L1–LN to ground potential, e.g., via sense resistor $R_{SENSE}$ in embodiments including $R_{SENSE}$, or directly to ground potential in embodiments that do not include $R_{SENSE}$. In any case, any of the illustrated switches SA, SB and S1–SN may take many physical forms including for example, but not limited to, relays, transistor switches, silicon-controlled rectifiers (SCRs), or any other known electronically controllable switch.

Control computer 20 further includes a number of inputs for receiving signals relating to the operation of circuit and system 10. For example, control computer 20 includes a boost voltage input, VBOOST, electrically connected to the capacitor C and receiving the boost voltage, VBOOST, supplied by the capacitor C to the boost switch SB. Control computer 20 further includes a sense voltage input, VSENSE, electrically connected to the high side of the sense resistor, $R_{SENSE}$, and receiving the voltage across $R_{SENSE}$, which corresponds to the load current flowing through the various inductive loads L1–LN when the corresponding low-side switches S1–SN are closed. Control computer 20 further includes a voltage source feedback input, VSFB, electrically connected to the output of a buffer circuit, B, having a single input electrically connected to the high sides of the inductive loads L1–LN. The resistor, R, acts a pull-up resistor between the high sides of the inductive loads, L1–LN, and the battery voltage source, VBATT. In an alternative embodiment, the terminal of resistor R shown in FIG. 1 as being connected to VBATT may be instead connected to an auxiliary voltage source producing an auxiliary voltage that is greater that the logic high switch point of the buffer circuit, B; e.g., 6 volts. The buffer circuit B produces a first logic state, e.g., high logic level, when the boost switch, SB, is closed, the battery switch, SA, is closed, or the boost switch, SB, battery switch, SA, and all of the low-side switches, S1–S2, are all open and no current is flowing through the recirculation diode DB, e.g., the load currents $I_{L1}$–$I_{LN}$ have decayed below a threshold current level, and otherwise produces a second logic state, different than the first logic state, e.g., low logic state. The voltage source feedback signal, VSFB, produced by the buffer circuit is a switching signal that switches between the first and second logic states as just described.

Figure 2:
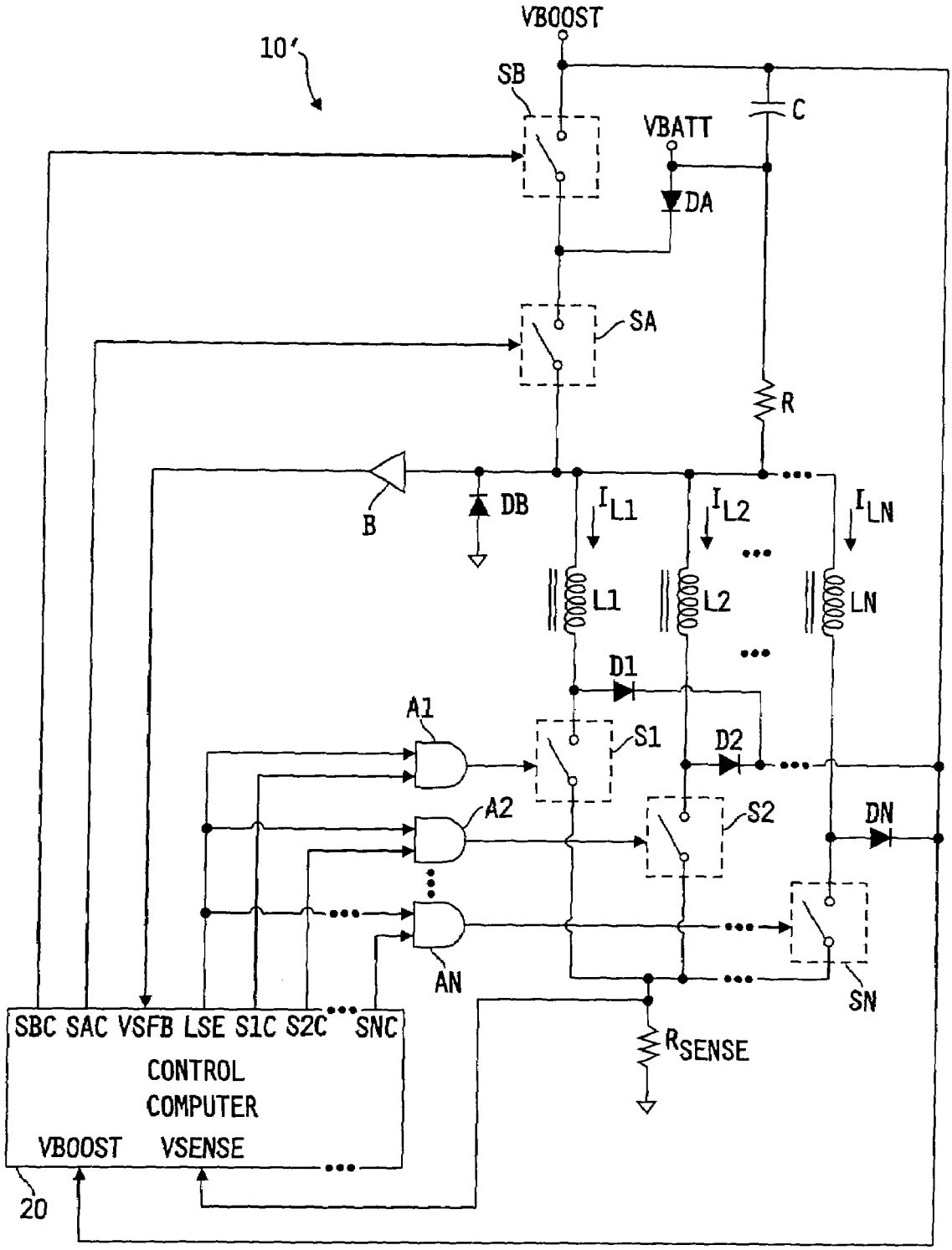
FIG. 2 is a diagram of another illustrative embodiment of an inductive load driver circuit and system.

Referring now to FIG. 2, a diagram of another illustrative embodiment of an inductive load driver circuit and system 10' is shown. Circuit and system 10' is identical in many respects to the circuit and system 10 illustrated in FIG. 1, and like reference characters are accordingly used to identify like components. Circuit and system 10' differs from circuit and system 10 in that the anode of the blocking diode, DA, in circuit and system 10' is connected to the battery voltage source, VBATT, and the cathode of the blocking diode, DA, is connected to one terminal of the battery switch, SA, with the opposite terminal of switch SA connected to the high sides of the inductive loads L1–LN. The battery switch, SA, is configured in its closed position, in this embodiment, to connect the battery voltage, VBATT, to the high sides of the inductive loads L1–LN. The terminal of the boost switch, SB, opposite that connected to capacitor C is also electrically connected in circuit and system 10' to the cathode of the blocking diode DA. The boost switch, SB, is configured in its closed position, in this embodiment, to connect the boost voltage, VBOOST, to the battery switch, SA, and therefore to the high sides of the inductive loads L1–LN when switch SA is closed. The blocking diode, DA, is configured to block current flow through either of switches SA and SB to the battery voltage source, VBATT.

Either of circuit and system 10 illustrated in FIG. 1, and circuit and system 10' illustrated in FIG. 2, is configured to control current flow through the number of inductive loads L1–LN and to selectively directing energy in the inductive loads L1–LN to the capacitor C. The capacitor C is thereby charged to achieve a desired boost voltage, VBOOST as will be described in greater detail hereinafter.

Figure 3:
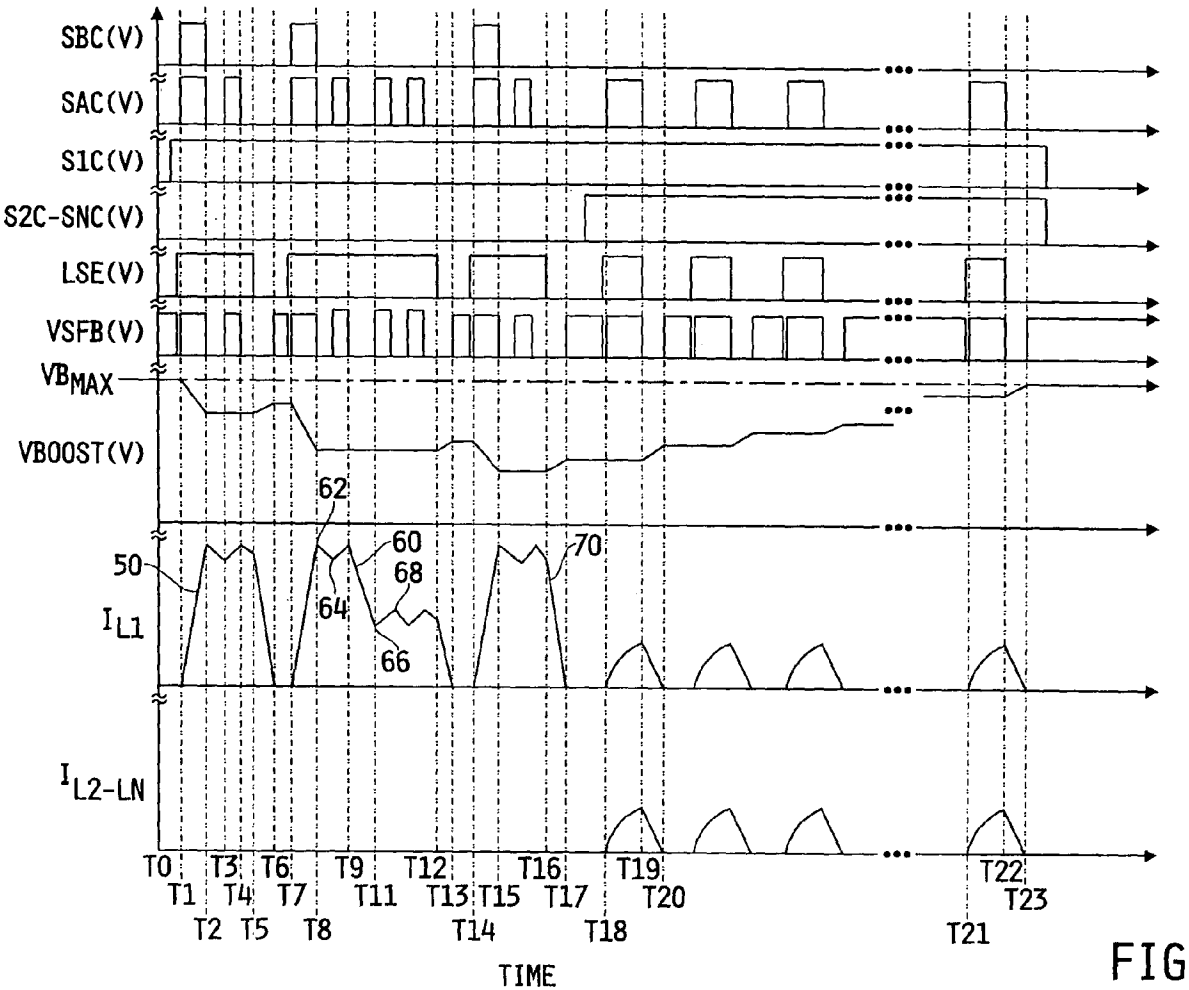
FIG. 3 is a plot of a number of signal waveforms associated with of either of the inductive load driver circuit and system embodiments of FIGS. 1 and 2 illustrating operation thereof.

Referring now to FIG. 3, a number of signal waveforms associated with either of the inductive load driver circuit and system embodiments 10 and 10' of FIGS. 1 and 2 respectively are shown illustrating example operation thereof. In the illustrated example, the inductive loads L1–LN are solenoids operable to control associated fuel injectors for an internal combustion engine. Fueling for such an internal combustion engine may include a main fueling pulse that is controllably shaped by the control computer 20 via control of the solenoid current. One example main fueling pulse is a so-called "ramp and pull-in" fueling pulse, wherein the solenoid current is rapidly increased to a target solenoid current, and then controllably held at the target solenoid current for the duration of the fuel injection event. Another example main fueling pulse is a so-called "ramp, pull-in and hold" fueling pulse, wherein the solenoid current is rapidly increased to a "pull-in" current, controllably held at the "pull-in" current for a desired duration, thereafter rapidly reduced to a "hold" current and controllably held at the "hold" current for the duration of the pulse. The main fuel injection pulse may further include one or more "pre-" or "pilot" injection fueling pulses and/or one or more "post-injection" fueling pulses. In the example illustrated in FIG. 3, each fuel injection event includes a single "ramp and pull-in" pre-injection pulse 50, followed by a main "ramp, pull-in and hold" injection pulse 60, followed by a single "ramp and pull-in" post-injection pulse 70. This is illustrated by the load current waveform $I_{L1}$, which is the load current inductive load L1. Although only a single such fuel injection event for solenoid L1 is illustrated in FIG. 3, it will be understood that each solenoid is continually controlled and actuated by control computer 20 to provide continual fueling events for fueling the engine.

The following is a description of a single fuel injection event using solenoid L1, and this description is applicable to any fuel injection event for any of the remaining "N" fuel injector solenoids L2–LN. In this description, corresponding to the waveforms illustrated in FIG. 3, all of the switches, e.g., SA, SB and S1–SN, are active high and normally open such that a high logic level at their corresponding control inputs, e.g., SAC, SBC and S1C–SNC, causes each of these switches to close and a low logic level at their corresponding control inputs causes them to open. Those skilled in the art will recognize that these switches may alternatively be active low and/or be normally closed, and that any such alternate configuration of these switches falls within the scope of the claims appended hereto.

At some time between time T0 and T1, control computer 20 is operable to produce a logic high signal at output S1C to select L1 for operation. Just prior to time T1, control computer 20 is operable to produce a logic high load switch enable value, LSE, which, together with the logic high signal at output S1C closes the low-side switch S1. Thereafter at time T1, control computer 20 is operable to simultaneously close the battery switch, SA, and the boost switch, SB. The closing of these switches completes a circuit path from the capacitor, C, through L1 and $R_{SENSE}$ to ground potential, thereby causing the load current $I_{L1}$ to rapidly increase due to the inductive nature of L1. At time T2 the load current $I_{L1}$ has reached its calibratible peak current 52, and control computer 20 simultaneously opens switches SA and SB. Closing the boost switch, SB, from T1 to T2 connects the boost voltage, VBOOST, to the high side of solenoid L1, and some of the charge on the capacitor C is depleted energizing the solenoid L1 as illustrated by the VBOOST waveform between T1 and T2. In many applications, as illustrated in this example, control computer 20 is operable to close the boost switch, SB, only when energizing a solenoid from a de-energized or other low energy state to the calibratible peak current. This impresses the boost voltage, VBOOST, which is typically much higher than the battery voltage, VBATT, across the selected solenoid, which in turn causes the load current therethrough to rise substantially faster than would otherwise occur resulting from applying only the battery voltage, VBATT, across the selected solenoid. Generally, a higher boost voltage, VBOOST, corresponding to a higher charge on capacitor C, results in a faster load current rise time.

In any case, the opening of switches SA and SB at time T2 causes the load current $I_{L1}$ to recirculate through the recirculation diode DB until it decays to a calibratible valley current 54 at time T3. At T3, control computer is operable to close switch SA, thereby causing the load current $I_{L1}$ to again increase until it reaches the calibratible peak current 52 at time T4. At T4, control computer 20 is again operable to open switch SA, thereby causing the load current $I_{L1}$ to decay. This pattern of controlling the load current $I_{L1}$ through solenoid L1 between the calibratible peak 52 and valley current 54 values continues for the duration of the pre-injection pulse 50, and at time T5 control computer 20 is operable to produce a logic low value at LSE to thereby open the low-side switch S1. The energy still present in L1 when low-side switch S1 is opened is commutated via commutation diode D1 back to the boost voltage storage capacitor, C, to thereby add charge to capacitor C and increase the boost voltage, as illustrated by the VBOOST waveform from T5, when low-side switch S1 is first opened, to T6, when the load current $I_{L1}$ has fully decayed. In general, energy stored in any solenoid L1–LN is commutated back to the capacitor, C, to add charge to the capacitor any time that the boost switch, SB, and a corresponding low-side switch, S1–SN, are open. In the embodiment illustrated in FIG. 3, the battery switch, SA, is maintained in an open position; e.g., SAC voltage is a logic low level, when commutating energy stored in any of the inductive loads L1–LN back to the capacitor, C, as just described. Alternatively, the control computer 20 may be operable to control the battery switch, SA, to a closed position whenever commutating energy stored in any of the inductive loads L1–LN back to the capacitor, C, as illustrated by example in FIG. 4. In the former case, the energy stored in any of the inductive loads L1–LN is commutated back to the series combination of the capacitor, C, and the voltage source, VBATT, and some of the commutated energy is thus absorbed by the battery voltage source, VBATT. In the latter case, all of the energy stored in any of the inductive loads L1–LN is commutated back to the capacitor, C.

Just prior to time T7, control computer 20 is again operable to produce a logic high load switch enable value, LSE, which, together with the existing logic high signal at output S1C again closes the low-side switch S1. Thereafter at T7, the main fuel injection pulse 60 begins where control computer 20 simultaneously closes the battery switch, SA, and the boost switch, SB. The closing of these switches again completes a circuit path from the capacitor, C, through L1 and $R_{SENSE}$ to ground potential, thereby causing the load current $I_{L1}$ to increase, as described hereinabove, during the "ramp" portion of the main fuel injection pulse 60. At time T8 the load current $I_{L1}$ has reached its calibratible peak current 62, and control computer 20 simultaneously opens switches SA and SB. Closing the boost switch, SB, from T7 to T8 connects the boost voltage, VBOOST, to the high side of solenoid L1, and some of the charge on the capacitor C is depleted energizing the solenoid L1 as illustrated by the VBOOST waveform between T7 and T8.

The opening of switches SA and SB at time T8 causes the load current $I_{L1}$ to recirculate through the recirculation diode DB until it decays to a calibratible valley current 64, at which time the control computer 20 is operable to close switch SA, thereby causing the load current $I_{L1}$ to again increase until it reaches the calibratible peak current 62 at time T9. This pattern of controlling the load current $I_{L1}$ between the calibratible peak current 62 and valley current 64 values continues for the duration of the "pull-in" portion of the main fuel injection pulse 60. At some point in time, e.g., T9, control computer 20 is operable to control the load current $I_{L1}$ from the "pull-in" portion of the main fuel injection pulse 60 to the "hold" portion of the pulse by opening low-side switch S1 (and the battery switch, SA) until the load current $I_{L1}$, decays (recirculates through DB) to a value near a calibratible hold valley current value 66 at time T10. At time T10, the low-side switch, S1, is again closed before the load current $I_{L1}$ reaches the hold valley current value 66. The time duration between T10 and T11 must be long enough to allow the load current path through L1, S1 and $R_{Sense}$ to become re-established before the load current $I_{L1}$ decays below the hold valley current value 66.

At T11, control computer 20 is operable to again close switch SA, causing the load current $I_{L1}$ to thereafter increase to a calibratible hold peak value 68. This pattern of controlling the load current $I_{L1}$ between the calibratible hold valley 66 and calibratible hold peak 68 values continues for the duration of the "hold" portion of the main fuel injection pulse 66. At some point in time, e.g., T12, control computer 20 is operable to terminate the main fuel injection pulse 60 by producing a logic low value at LSE to thereby open the low-side switch S1. The energy still present in L1 when low-side switch S1 is opened at T12 is again commutated via commutation diode D1 back to the boost voltage storage capacitor, C, to thereby add charge to capacitor C and increase the boost voltage, as illustrated by the VBOOST waveform from T12, when low-side switch S1 is opened, to T13, when the load current $I_{L1}$ has fully decayed. Control computer 20 is thereafter operable between times T14 and T17 to provide for a post-injection pulse 70 in an identical manner to that described hereinabove with respect to the pre-injection pulse.

It will be understood that in the foregoing description, control computer 20 is operable to control the load current, $I_{L1}$–$I_{LN}$, through any of the inductive loads L1–LN to achieve current peaks and valleys in the fuel injection event illustrated by waveforms 50, 60 and 70 by monitoring the voltage drop, $V_{SENSE}$, across the sense resistor, $R_{SENSE}$, and controlling the various switches SA, SB and S1–SN to control $I_{L1}$–$I_{LN}$ to corresponding calibratible target values, in a manner known in the art.

Following the fuel injection portion of the fuel injection event, e.g., injection pulses 50, 60 and 70, control computer 20 is operable to periodically command a number of capacitor recharge pulses to charge capacitor C to its pre-fuel injection charge level, e.g., $VB_{MAX}$. Control computer 20 may be operable to command the number of capacitor recharge pulses by periodically energizing any one or more of the solenoids L1–LN and commutating this energy back to the capacitor C, via associated commutating diodes D1–DN, to increase its charge. In the illustrated example, control computer 20 is operable to command the number of capacitor recharge pulses by periodically energizing all "N" of the solenoids L1–LN, as illustrated in FIG. 3, although it will be understood that control computer 20 may alternatively periodically energize any one or combination of the "N" solenoids L1–LN. In general, increasing the number of solenoids periodically energized by the capacitor recharge pulses will increase the quantity of energy commutated back to the capacitor C for each capacitor recharge pulse, and will therefore reduce the total amount of time required to charge the capacitor. In one embodiment, control computer 20 is operable to periodically command the number of capacitor recharge pulses at predetermined time intervals. Alternatively, control computer 20 may be operable to periodically command the number of capacitor recharge pulses at predetermined crank angles or crank angle intervals. Those skilled in the art will recognize other strategies for periodically commanding the number of capacitor recharge pulses, and any such other strategies are intended to fall within the scope of the claims appended hereto.

Figure 4:
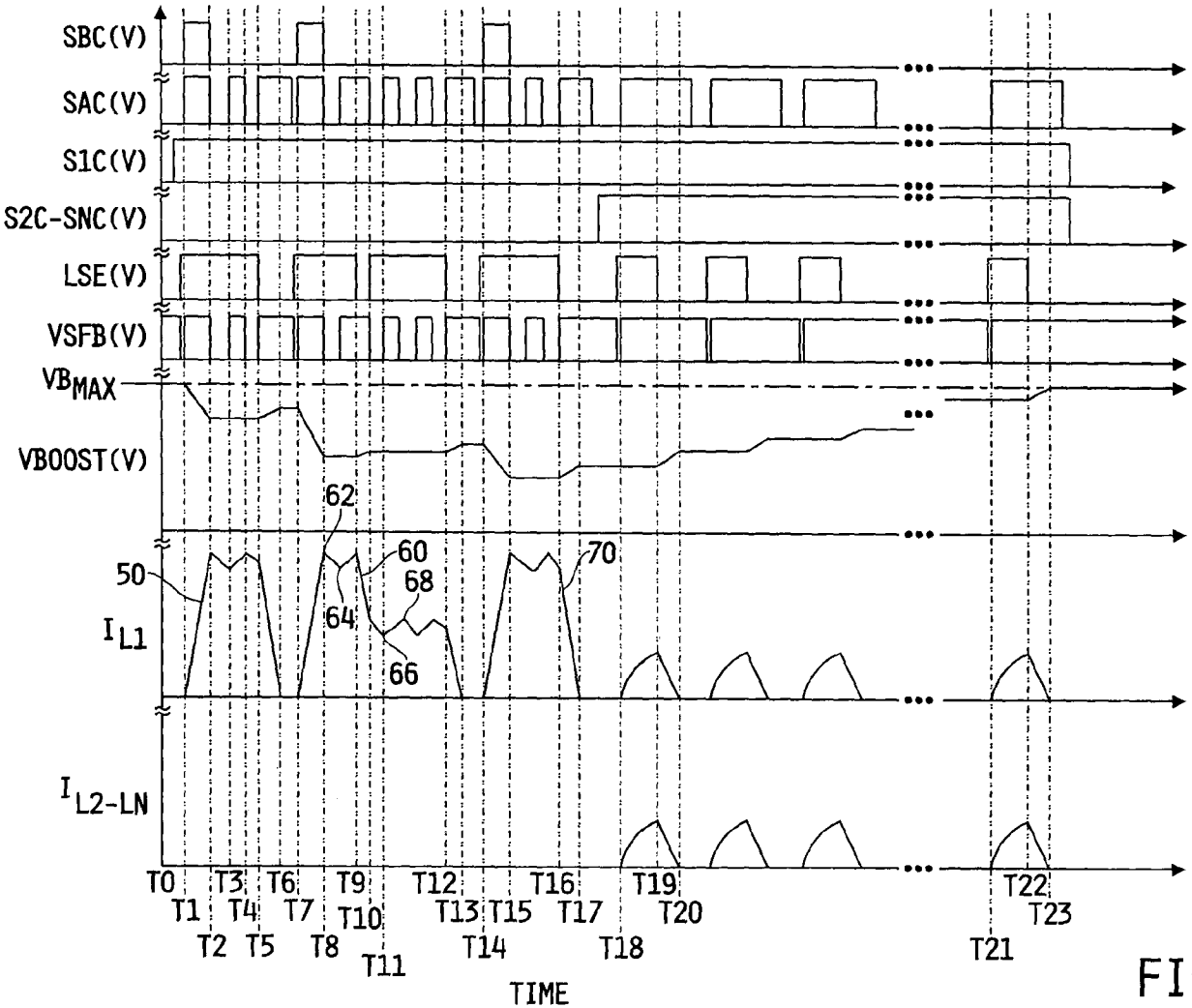
FIG. 4 is a plot of a number of signal waveforms associated with of either of the inductive load driver circuit and system embodiments of FIGS. 1 and 2 illustrating alternate operation thereof.

In the illustrated example, control computer 20 is operable to command each of the series of capacitor recharge pulses by first producing a logic high load switch enable value, LSE, which, together with logic high signals at output S1C–SNC closes each of the low-side switches S1–SN. Thereafter, control computer 20 is operable to maintain the boost switch, SB, open and close the battery switch, SA, e.g., at time T18, to thereby cause load currents $I_{L1\text{-}LN}$ through the solenoids L1–LN to each increase to a load current limit, followed by controlling the battery switch, SA, and each of the low-side switches, S1–SN, via the load switch enable signal, LSE, to open each of these switches, e.g., at time T19. Controlling the various switches SA, SB and S1–SN as just described causes the energy, e.g., current, stored in each of the solenoids, L1–LN, to be commutated back to the capacitor, C, via corresponding commutating diodes D1–DN. In an alternate embodiment, as illustrated in FIG. 4, control computer 20 is operable to maintain the battery switch, SA, in its closed position when the low-side switches, S1–SN, are opened to commutate energy back to capacitor, C, for reasons previously described, and to open the battery switch, SA, some time after the solenoid currents, $I_{L1}$–$I_{LN}$, have fully decayed, e.g., some time after T7, T13, T17, T20 and T23. In any case, energy that is periodically stored in each of the solenoids, L1–LN, is thus dissipated in the form of charge successively applied to the capacitor, C, as illustrated by the VBOOST waveform in FIGS. 3 and 4. The capacitor charging portion of the fuel injection event just described is complete when the charge on the capacitor, C, has been restored to its calibratible voltage level, $VB_{MAX}$. In one embodiment, for example, control computer 20 is operable to monitor the boost voltage, VBOOST, as illustrated in FIGS. 1 and 2, and command capacitor recharge pulses until the boost voltage, VBOOST, reaches $VB_{MAX}$. The number of capacitor recharge pulses required to accomplish this will vary depending upon a number of factors including, but not necessarily limited to, the capacitance value of the capacitor, C, the voltage level of the battery voltage source, VBATT, the desired VBOOST voltage level, the inductance value of the inductive loads, L1–LN, and the like. In the illustrated embodiment, the final capacitor recharge pulse of the fuel injection event occurs between times T21 and T23.

Control computer 20 is operable to command each of the number of capacitor recharge pulses, as just described, such that the load current therethrough increases only to a maximum current limit that is below a current level sufficient to actuate a corresponding fuel injector in order to avoid injection of fuel during the capacitor recharging portion of the fuel injection event. In one embodiment, control computer 20 is operable to so limit the load current through each of the solenoids, L1–LN, by monitoring the load currents, $I_{L1}$–$I_{LN}$, via VSENSE, and opening the low-side switches, S1–SN, when the load currents, $I_{L1}$–$I_{LN}$, reach a calibratible load current limit. In an alternative embodiment, control computer 20 is operable to limit load current through each of the solenoids, L1–LN, by controlling the duration of the time that the battery switch, SA, and each of the low-side switches, S1–SN, are closed, e.g., the time duration between T18 and T19, to a time duration target. The time duration target value will be dependent upon a number of factors including, but not necessarily limited to, the inductance value of the inductive loads, L1–LN, the voltage level of the battery voltage source, VBATT, and the like. In one embodiment, the time duration target value is determined by control computer 20 as a function of battery voltage, VBATT. Alternatively or additionally, the time duration target value may be determined by control computer 20 as a function of boost voltage, VBOOST.

As described hereinabove, the voltage source feedback signal, VSFB, is a logic level representation of the voltage state of the high sides of the inductive loads, L1–LN. In the circuit and system embodiments 10 and 10' illustrated in FIGS. 1 and 2 respectively, the voltage source feedback signal exhibits a first logic state, e.g., high logic level, when the boost switch, SB, is closed, the battery switch, SA, is closed, or the boost switch, SB, battery switch, SA, and all of the low-side switches, S1–S2, are all open and no current is flowing through the recirculation diode DB, e.g., the load currents $I_{L1}$–$I_{LN}$ have decayed below a threshold current level, and otherwise produces a second logic state, different than the first logic state, e.g., low logic state. From the VSFB signal, control computer 20 can determine useful information relating to the operation of circuit and system 10 or 10', as illustrated in FIGS. 3 and 4. For example, as described hereinabove, the control computer 20 is operable to initiate each of the series of current pulses that result in the pre-injection pulse 50, the main injection pulse 60, the post-fueling injection pulse 70 and each of the capacitor recharge pulses, by first controlling one or more of the low-side switches, S1–SN, to their closed position followed by controlling either of the boost switch and the battery switch to its closed position to cause the load current through the inductive load to increase. More specifically, control computer 20 is operable to initiate each of the pre-injection fueling pulses 50, main-injection fueling pulses 60 and post-injection fueling pulses 70 for any of the solenoids L1–LN by first controlling an appropriate one of the low-side switches, S1–SN, to its closed position, followed by controlling both of the boost switch, SB, and the battery switch, SA, to their closed positions as illustrated in FIG. 3. Similarly, control computer 20 is operable to initiate each of the capacitor recharge pulses by first controlling each, or any or more, of the low-side switches, S1–SN, to its closed position, followed by controlling the battery switch, SA, to its closed position. Under normal operation, while all of the switches SA, SB and S1–SN are open prior to any of these current pulses, no load current, $I_{L1}$–$I_{LN}$, is flowing through any of the corresponding solenoids, L1–LN, and the voltage source feedback signal, VSFB, is accordingly at a high logic state. Thereafter when one or more of the low-side switches, S1–SN, is closed, VSFB switches from its high logic state to a low logic state. Following the closing of the one or more low-side switches, S1–SN, closing of either the battery switch, SA, and/or boost switch, SB, causes the voltage source feedback signal, VSFB, to switch back from its low logic state to its high logic state.

The foregoing operation of VSFB during initiation of any of the load current pulses may be used as a diagnostic indicator to identify open or short circuit conditions. For example, if the voltage source feedback signal, VSFB, is not in its high logic state when all switches, SA, SB and S1–SN are open with no load current, $I_{L1}$–$I_{LN}$ flowing through any of the corresponding solenoids, L1–LN, and/or if VSFB is in it high logic state but fails to switch to its low logic state when any of the low-side switches, S1–SN, are thereafter closed, this is an indication of an open or short circuit condition in the circuitry 10 or 10I. In one embodiment, the control computer 20 is operable to monitor the voltage source feedback signal, VSFB, and control either of the boost switch, SB, and/or the battery switch, SA, to its closed position, following closing of one or more of the low-side switches, S1–SN, at the initiation of a load current pulse, only if the voltage source feedback signal, VSFB, is in its low logic state after the one or more low-side switches, S1–SN, are controlled to their closed position. Alternatively or additionally, the control computer 20 may be operable to monitor VSFB and control either of the boost switch, SB, and/or the battery switch, SA, to its closed position, following closing of one or more of the low-side switches, S1–SN, at the initiation of a load current pulse, only if VSFB switches from its high logic state to its low logic state when the one or more low-side switches are controlled to their closed positions. In either case, control computer 20 is otherwise operable to disable further load current injection pulses.

As another example of information provided by VSFB, control computer 20 can similarly determine from the VSFB signal the duration of the rise in load current from substantially zero to its initial peak current level at the beginning of any of the pre-injection 50, main injection 60 and post-injection 70 fuel pulse. As illustrated in FIGS. 3 and 4, when any of the fuel pulses 50, 60 or 70 is initiated as just described, control computer 20 is operable to monitor VSENSE and control the boost switch, SB, and the battery switch, SA, to their open positions when the corresponding load current, $I_{L1\text{-}N}$, reaches its calibratible initial peak current level, at which time the voltage sense feedback signal, VSFB, switches from its logic high state to its logic low state. In one embodiment, the control computer 20 is configured to determine the duration of load current rise to the peak current level; e.g., 62 of the main injection pulse 60, as a time difference between switching of VSFB from its low logic state to its high logic state when the boost switch, SB, and battery switch, SA, are controlled to their closed positions, e.g., at time T7, and switching of VSFB from its high logic state to its low logic state when the boost switch, SB, and battery switch, SA, are thereafter controlled to their open position, e.g., at time T8.

The VSFB signal can further be used generally by the control computer 20 as an indirect indicator of solenoid response time, and may therefore be used, employing known control techniques, for purposes of compensating for system-to system differences including solenoid-to-solenoid differences, control computer-to-control computer differences, and the like.

It will be understood that the voltage source feedback signal, VSFB, as just described, does not require the boost voltage, VBOOST, to provide the foregoing information. In this regard, the VFSB signal will provide all of the foregoing information in embodiments of circuit and system 10 or 10' having capacitor, C, boost switch, SB, commutating diodes D1–DN, and low-side switches S1–SN omitted therefrom.

Referring now to FIG. 4, a number of signal waveforms associated with of either of the inductive load driver circuit and system embodiments 10 and 10' of FIGS. 1 and 2 respectively are shown illustrating another example operation thereof. The example operation illustrated in FIG. 4 is identical in many respects to the example operation illustrated in FIG. 3, and like reference characters are accordingly used to identify like signals and signal features. In this example, control computer 20 is operable to command a low-level load switch enable signal, LSE, during the decay of the main injector pulse 60 between the pull-in to hold mode transition, e.g., between T9 and T11. LSE, in this example, is commanded low for a time period between T9 and T10, at which time solenoid energy is transferred or commutated from L1 back to capacitor, C, via commutating diode D1. A resultant rise in the boost voltage, VBOOST, as charge is added back to the capacitor, C, is realized between T9 and T10 as illustrated in FIG. 4. LSE must be commanded high, in this example, before T11 for a time period sufficient to allow current feedback to be re-enabled before the load current IL1 reaches the hold valley current value 66. The voltage source feedback voltage, VSFB, can be used by the control computer 20 to configure this recovery time in an optimal manner, such as by adaptively adjusting the timing of the LSE rising edge at time T10 such that it will optimally occur before the VFSB transition at T11.

Further illustrated in FIG. 4 is the battery switch control waveform, SAC, shown as being controlled to its closed position, e.g., SAC voltage at a logic low level, whenever energy stored in any of the inductive loads L1–LN is being commutated back to capacitor, C, as illustrated by the rising portions of the VBOOST waveform. For example, between times T5 and just after T6, T10 and T11, T12 and just after T13, T16 and just after T17, T19 and just after T20, and T22 and just after T23.

It will be understood that circuit and system 10 or 10' may be configured in the manner just described with respect to FIG. 4 to provide for energy recovery from any solenoid, L1–LN, any time that load current is decaying therefrom, e.g., between the various peak and valley current values illustrated and described herein.

While the invention has been illustrated and described in detail in the foregoing drawings and description, the same is to be considered as illustrative and not restrictive in character, it being understood that only preferred embodiments thereof have been shown and described and that all changes and modifications that come within the spirit of the invention are desired to be protected. For example, in fuel injection control systems of the type described hereinabove, any number of circuit and system units 10 or 10' may be used to control any number of fuel injectors. In one specific 6-cylinder internal combustion engine embodiment including one injector per cylinder, for example, two circuit and system units 10 or 10' are used, one to control each of a bank of three fuel injectors. In such an embodiment, the two sets of circuit and system 10 or 10' may include separate capacitors, C, as illustrated herein, or may alternatively share a single, common, suitably sized capacitor. As another example, the operational examples illustrated in FIGS. 3 and 4 show the load current $I_{L1}$ between peak and valley values primarily controlled via control of the battery switch, SA. Those skilled in the art will recognize that such control could alternatively be accomplished via similar control of the individual low-side switches S1–SN, and/or by combined control of any combination of the battery switch, SA, the boost switch, SB, and the number of low-side switched S1–SN, and any such alternate control is intended to fall within the scope of the claims appended hereto.

What is claimed is:

1. Circuitry for driving an inductive load, the circuitry comprising:

a battery switch having an open position and a closed position supplying a battery voltage to a high side of the inductive load;

a boost switch having an open position and a closed position supplying a boost voltage, greater than the battery voltage, to the high side of the inductive load;

a low-side switch having an open position and a closed position coupling a low-side of the inductive load to ground potential;

a capacitor having one terminal referenced to the battery voltage and an opposite terminal supplying the boost voltage to the boost switch;

a commutating diode having an anode connected to the low-side of the inductive load and a cathode connected to the opposite terminal of the capacitor; and a control computer controlling the battery switch, boost switch and low-side switch to control current flow through the inductive load, the control computer directing energy in the inductive load to the opposite terminal of the capacitor via the commutating diode to charge the capacitor by controlling the boost switch and the low-side switch to their open positions.

2. The circuitry of claim 1 wherein the control computer is further operable to control the battery switch to its closed position when directing energy in the inductive load to the opposite terminal of the capacitor via the commutating diode.

3. The circuitry of claim 1 wherein the control computer is further operable to control the battery switch to its open position when directing energy in the inductive load to the opposite terminal of the capacitor via the commutating diode.

4. The circuitry of claim 1 further including a blocking diode having an anode connected to one terminal of the battery switch and a cathode connected to the high side of the inductive load;

wherein an opposite terminal of the battery switch is connected to the battery voltage, the battery switch configured in its closed position to connect the battery voltage to the high side of the inductive load with the blocking diode blocking current flow through the battery switch to the battery voltage, and it its open position to disconnect the battery voltage from the high side of the inductive load.

5. The circuitry of claim 4 wherein one terminal of the boost switch is connected to the opposite terminal of the capacitor, and an opposite terminal of the boost switch is connected to the high side of the inductive load, the boost switch configured in its closed position to connect the boost voltage to the high side of the inductive load, and in its open position to disconnect the boost voltage from the high side of the inductive load.

6. The circuitry of claim 1 further including a blocking diode having an anode connected to the battery voltage and a cathode connected to one terminal of the battery switch;

wherein an opposite terminal of the battery switch is connected to the high side of the inductive load, the battery switch configured in its closed position to connect the battery voltage to the high side of the inductive load with the blocking diode blocking current flow from the one terminal of the battery switch to the battery voltage, and it its open position to disconnect the battery voltage from the high side of the inductive load.

7. The circuitry of claim 6 wherein one terminal of the boost switch is connected to the opposite terminal of the capacitor, and an opposite terminal of the boost switch is connected to the one terminal of the battery switch, the boost switch configured in its closed position to connect the boost voltage to the high side of the inductive load when the battery switch is also in its closed position, and in its open position to disconnect the boost voltage from the one terminal of the battery switch.

8. The circuitry of claim 1 wherein the inductive load is a solenoid configured to control operation of a fuel injector.

9. The circuitry of claim 1 further including:

a recirculation diode having a cathode connected to the high side of the inductive load and an anode connected to ground potential, the recirculation diode conducting load current therethrough when the load current is decaying through the inductive load; and a buffer circuit having an input connected to the high side of the inductive load and an output producing a voltage source feedback signal, the voltage source feedback signal having a first logic state when any of the boost switch is in its closed position, the battery switch is in its closed position and the boost switch, battery switch and low-side switch are all in their open positions and no load current from the inductive load is being conducted through the recirculation diode, and otherwise having a second logic state different than the first logic state.

10. The circuitry of claim 9 wherein the control computer is configured to control the battery switch, boost switch and low-side switch to control load current flow through the inductive load according to a series of current pulses.

11. The circuitry of claim 10 wherein the control computer is configured to initiate each of the series of current pulses by controlling the low-side switch to its closed position followed by controlling either of the boost switch and the battery switch to its closed position to cause the load current through the inductive load to increase, the control computer monitoring the voltage source feedback signal and controlling either of the boost switch and the battery switch to its closed position only if the voltage source feedback signal is in its second logic state after the low-side switch is controlled to its closed position.

12. The circuitry of claim 11 wherein the voltage source feedback signal indicates a circuit open or short condition if the voltage source feedback signal is in its first logic state after the low-side switch is controlled to its closed position.

13. The circuitry of claim 11 wherein each of the boost switch, the battery switch and the low-side switch is in its open position with no load current flowing through the recirculation diode prior to controlling the low-side switch to its closed position, the control computer controlling either of the boost switch and the battery switch to its closed position only if the voltage source feedback signal switches from its first logic state to its second logic state when the low-side switch is controlled to its closed position.

14. The circuitry of claim 13 wherein the voltage source feedback signal indicates a circuit open or short condition if the voltage source feedback signal is either of in its second logic state before the low-side switch is controlled to its closed position and in its first logic state after the low-side switch is controlled to its closed position.

15. The circuitry of claim 11 wherein the control computer is configured to control either of the boost switch and the battery switch to its open position when the load current through the inductive load increases to a peak current level.

16. The circuitry of claim 15 wherein the control computer is configured to determine a duration of load current rise to the peak current level as a time difference between switching of the voltage source feedback signal from its second logic state to its first logic state when either of the boost switch and the battery switch is controlled to its closed position and switching of the voltage source feedback signal from its first logic state to its second logic state when either of the boost switch and the battery switch is thereafter controlled to its open position.

17. The circuitry of claim 1 further including:

a plurality of inductive loads having high sides all connected together;

a corresponding plurality of commutating diodes each having an anode connected to a low-side of an associated one of the plurality of inductive loads, and a cathode connected to the opposite terminal of the capacitor; and a corresponding plurality of low-side switches each having an open position and a closed position coupling a low-side of an associated one of the plurality of inductive loads to ground potential;

wherein the control computer is configured to control the battery switch, boost switch and plurality of low-side switches to control current flow through the plurality of inductive loads, the control computer directing energy from the plurality of inductive loads to the opposite terminal of the capacitor via associated ones of the plurality of commutating diodes to charge the capacitor by controlling the boost switch and the associated ones of the plurality of low-side switches to their open positions.

18. The circuitry of claim 17 wherein the control computer is further operable to control the battery switch to its closed position when directing energy in the plurality of inductive loads to the opposite terminal of the capacitor via the associated ones of the plurality of commutating diodes.

19. The circuitry of claim 17 wherein the control computer is further operable to control the battery switch to its open position when directing energy in the plurality of inductive loads to the opposite terminal of the capacitor via the associated ones of the plurality of commutating diodes.

20. The circuitry of claim 17 wherein the control computer is configured to command a series of capacitor recharge pulses to recharge the capacitor, the control computer configured for each of the series of capacitor recharge pulses to control the battery switch and each of the plurality of low-side switches to their closed positions while controlling the boost switch to its open position to cause load currents through each of the plurality of inductive loads to increase, followed by controlling each of the plurality of low-side switches to their open positions to direct energy from each of the plurality of inductive loads through a respective one of the plurality of commutating diodes to the opposite terminal of the capacitor.

21. The circuitry of claim 20 wherein the capacitor is further operable to control the battery switch to its closed position when directing energy from each of the plurality of inductive loads through a respective one of the plurality of commutating diodes to the opposite terminal of the capacitor.

22. The circuitry of claim 20 wherein the capacitor is further operable to control the battery switch to its open position when directing energy from each of the plurality of inductive loads through a respective one of the plurality of commutating diodes to the opposite terminal of the capacitor.

23. The circuitry of claim 17 wherein each of the plurality of inductive loads is a solenoid configured to control operation of one of a corresponding plurality of fuel injectors.

24. Circuitry for driving an inductive load, the circuitry comprising:

a battery switch having an open position and a closed position supplying a battery voltage to a high side of the inductive load;

a low-side switch having an open position and a closed position coupling a low-side of the inductive load to ground potential;

a recirculation diode having a cathode connected to the high side of the inductive load and an anode connected to ground potential, the recirculation diode conducting load current therethrough when the load current is decaying through the inductive load;

a buffer circuit having an input connected to the high side of the inductive load and an output producing a voltage source feedback signal, the voltage source feedback signal having a first logic state when either of the battery switch is in its closed position and the battery switch and low-side switch are each in their open positions and no load current from the inductive load is being conducted through the recirculation diode, and otherwise having a second logic state different than the first logic state; and a control computer controlling the battery switch and the low-side switch to control load current through the inductive load according to a series of current pulses, the control computer initiating each of the series of current pulses by controlling the low-side switch to its closed position followed by controlling the battery switch to its closed position to cause the load current through the inductive load to increase, the control computer monitoring the voltage source feedback signal and controlling the battery switch to its closed position only if the voltage source feedback signal is in its second logic state after the low-side switch is controlled to its closed position.

25. The circuitry of claim 24 wherein the voltage source feedback signal indicates a circuit open or short condition if the voltage source feedback signal is in its first logic state after the low-side switch is controlled to its closed position.

26. The circuitry of claim 24 wherein the battery switch and the low-side switch are in their open positions with no load current flowing through the recirculation diode prior to controlling the low-side switch to its closed position, the control computer controlling the battery switch to its closed position only if the voltage source feedback signal switches from its first logic state to its second logic state when the low-side switch is controlled to its closed position.

27. The circuitry of claim 26 wherein the voltage source feedback signal indicates a circuit open or short condition if the voltage source feedback signal is either of in its second logic state before the low-side switch is controlled to its closed position and in its first logic state after the low-side switch is controlled to its closed position.

28. The circuitry of claim 24 further including:

boost switch having an open position and a closed position supplying a boost voltage, greater than the battery voltage, to the high side of the inductive load;

a capacitor having one terminal referenced to the battery voltage and an opposite terminal supplying the boost voltage to the boost switch; and a commutating diode having an anode connected to the low-side of the inductive load and a cathode connected to the opposite terminal of the capacitor;

wherein the control computer is configured to control the boost switch to control load current through the inductive load, and to direct energy in the inductive load through the commutating diode to the opposite terminal of the capacitor to charge the capacitor by controlling the low-side switch and boost switch to their open positions.

29. The circuitry of claim 28 wherein the control computer is further operable to control the battery switch to its closed position when directing energy from the inductive load through the commutating diode to the opposite terminal of the capacitor.

30. The circuitry of claim 28 wherein the capacitor is further operable to control the battery switch to its open position when directing energy from the inductive load through the commutating diode to the opposite terminal of the capacitor.

31. The circuitry of claim 24 wherein the inductive load is a solenoid configured to control operation of a fuel injector.

32. Circuitry for driving an inductive load, the circuitry comprising:

a battery switch having an open position and a closed position supplying a battery voltage to a high side of the inductive load;

a boost switch having an open position and a closed position supplying a boost voltage, greater than the battery voltage, to the high side of the inductive load;

a capacitor supplying the boost voltage to the boost switch;

a low-side switch having an open position and a closed position coupling a low-side of the inductive load to ground potential;

a commutating diode having an anode connected to the low-side of the inductive load and a cathode connected to the capacitor;

a recirculation diode having a cathode connected to the high side of the inductive load and an anode connected to ground potential, the recirculation diode conducting load current therethrough when the load current is decaying through the inductive load;

a buffer circuit having an input connected to the high side of the inductive load and an output producing a voltage source feedback signal, the voltage source feedback signal having a first logic state when any of the boost switch is in its closed position, the battery switch is in its closed position and the boost switch, battery switch and low-side switch are all in their open positions and no load current from the inductive load is being conducted through the recirculation diode, and otherwise having a second logic state different than the first logic state; and a control computer configured to control the battery switch, boost switch and low-side switch to control load current flow through the inductive load according to a series of current pulses, the control computer initiating each of the series of current pulses by controlling the low-side switch to its closed position followed by controlling either of the boost switch and the battery switch to its closed position to cause the load current through the inductive load to increase, the control computer monitoring the voltage source feedback signal and controlling either of the boost switch and the battery switch to its closed position only if the voltage source feedback signal is in its second logic state after the low-side switch is controlled to its closed position.

33. The circuitry of claim 32 wherein the voltage source feedback signal indicates a circuit open or short condition if the voltage source feedback signal is in its first logic state after the low-side switch is controlled to its closed position.

34. The circuitry of claim 32 wherein each of the boost switch, the battery switch and the low-side switch is in its open position with no load current flowing through the recirculation diode prior to controlling the low-side switch to its closed position, the control computer controlling either of the boost switch and the battery switch to its closed position only if the voltage source feedback signal switches from its first logic state to its second logic state when the low-side switch is controlled to its closed position.

35. The circuitry of claim 34 wherein the voltage source feedback signal indicates a circuit open or short condition if the voltage source feedback signal is either of in its second logic state before the low-side switch is controlled to its closed position and in its first logic state after the low-side switch is controlled to its closed position.

36. The circuitry of claim 32 wherein the control computer is configured to control either of the boost switch and the battery switch to its open position when the load current through the inductive load increases to a peak current level.

37. The circuitry of claim 36 wherein the control computer is configured to determine a duration of load current rise to the peak current level as a time difference between switching of the voltage source feedback signal from its second logic state to its first logic state when either of the boost switch and the battery switch is controlled to its closed position and switching of the voltage source feedback signal from its first logic state to its second logic state when either of the boost switch and the battery switch is thereafter controlled to its open position.

38. Circuitry for driving a plurality of inductive loads, the circuitry comprising:

a battery switch having an open position and a closed position supplying a battery voltage to high sides of the plurality of inductive loads;

a boost switch having an open position and a closed position supplying a boost voltage, greater than the battery voltage, to the high sides of the plurality of inductive loads;

a plurality of low-side switches each having an open position and a closed position coupling a low-side of a corresponding one of the plurality of inductive loads to ground potential;

a capacitor supplying the boost voltage to the boost switch;

a plurality of commutating diodes each having an anode connected to the low-side of a corresponding one of the plurality of inductive loads and a cathode connected to the capacitor; and a control computer controlling the battery switch, boost switch and plurality low-side switches to control load current flow through the plurality of inductive loads, the control computer commanding a series of capacitor recharge pulses to recharge the capacitor by controlling the battery switch and each of the plurality of low-side switches to their closed positions while controlling the boost switch to its open position to cause load currents through each of the plurality of inductive loads to increase, followed by controlling each of the plurality of low-side switches to their open positions to direct energy from each of the plurality of inductive loads through a respective one of the plurality of commutating diodes to the capacitor.

39. The circuitry of claim 38 wherein the control computer is further operable to control the battery switch to its closed position when directing energy from each of the plurality of inductive loads through a respective one of the plurality of commutating diodes to the capacitor.

40. The circuitry of claim 38 wherein the control computer is further operable to control the battery switch to its open position when directing energy from each of the plurality of inductive loads through a respective one of the plurality of commutating diodes to the capacitor.

41. The circuitry of claim 38 wherein each of the plurality of inductive loads is a solenoid configured to control operation of one of a corresponding plurality of fuel injectors;

and wherein the control computer is configured to control the durations of the closed positions of the battery switch and each of the plurality of low-side switches for each of the series of capacitor recharge pulses to limit the load current through each of the plurality of solenoids below a level sufficient to actuate an associated one of the corresponding plurality of fuel injectors.

42. Circuitry for driving an inductive load, the circuitry comprising:

a high-side switch having an open position and a closed position supplying a source voltage to a high side of the inductive load;

a low-side switch having an open position and a closed position coupling a low-side of the inductive load to ground potential;

a recirculation diode having a cathode connected to the high side of the inductive load and an anode connected to ground potential, the recirculation diode conducting load current therethrough when the load current is decaying through the inductive load;

a buffer circuit having an input connected to the high side of the inductive load and an output producing a voltage source feedback signal, the voltage source feedback signal having a first logic state when either of the battery switch is in its closed position and the battery switch and low-side switch are each in their open positions and no load current from the inductive load is being conducted through the recirculation diode, and otherwise having a second logic state different than the first logic state; and a control computer controlling the low-side switch to its closed position followed by controlling the high-side switch to its closed position to cause the load current through the inductive load to increase, followed by controlling the high-side switch to its open position when the load current through the inductive load increases to a peak current level, the control computer determining a duration of load current rise to the peak current level as a time difference between switching of the voltage source feedback signal from its second logic state to its first logic state when the high-side switch is controlled to its closed position and switching of the voltage source feedback signal from its first logic state to its second logic state when the high-side switch is thereafter controlled to its open position.

* * * * *